US006123001A

United States Patent [19]

Andrich

[11] Patent Number: 6,123,001

[45] Date of Patent: Sep. 26, 2000

[54] DETONATING CORD CUTTER

[75] Inventor: Lyle Wayne Andrich, Gretna, La.

[73] Assignee: Owen Oil Tools, Inc., Fort Worth, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/022,294

[22] Filed: Feb. 11, 1998

[51] Int. Cl.[7] ..... B26B 13/00; B26B 17/00

[52] U.S. Cl. ..... 83/13; 30/91.2; 30/134; 30/258; 30/282; 30/289

[58] Field of Search ..... 83/13, 950; 30/134, 30/258, 91.2, 124, 112, 278, 282, 272.1, 289

[56] References Cited

U.S. PATENT DOCUMENTS

| | | | |
|---|---|---|---|
| 1,918,700 | 7/1933 | Harris | 30/134 X |
| 2,292,729 | 8/1942 | Woodward | 30/91.2 |
| 2,523,575 | 9/1950 | Kassel | 30/112 X |
| 2,627,655 | 2/1953 | Antonelli | 30/134 |
| 2,775,032 | 12/1956 | Sorensen | 30/134 |
| 3,816,919 | 6/1974 | Portnoy | 30/124 |
| 4,092,774 | 6/1978 | Watts | 30/124 X |
| 4,742,616 | 5/1988 | Lippert | 30/124 |
| 5,036,588 | 8/1991 | Cherry | 30/180 |
| 5,046,252 | 9/1991 | Ayuta et al. | 30/258 |
| 5,226,236 | 7/1993 | Harrington, III | 30/134 |
| 5,351,333 | 9/1994 | Chambers | 30/134 X |

FOREIGN PATENT DOCUMENTS

| | | | |
|---|---|---|---|
| 564998 | 11/1923 | France | 30/258 |

*Primary Examiner*—Rinaldi I. Rada
*Assistant Examiner*—Boyer Ashley
*Attorney, Agent, or Firm*—Charles D. Gunter, Jr.

[57] ABSTRACT

A device for cutting a detonating cord having an explosive core is provided. The device includes a detonating cord holding member having a cord holding portion, such as an aperture or recess, configured to closely receive the detonating cord so that the detonating cord is held in place relative to the holding member. The cord holding member also has a side surface from which the detonating cord projects when the detonating cord is held in the cord holding portion prior to cutting. A blade arm is pivotally mounted to the cord holding member. The blade arm carries a sharpened blade and is pivotal between an open and closed position. The blade passes over the cord holding portion in close proximity to the side surface so that the detonating cord is cut by the blade as the blade is passed over the cord holding portion.

14 Claims, 3 Drawing Sheets

DETONATING CORD CUTTER

BACKGROUND OF THE INVENTION

1. Field of the Invention

This invention relates generally to cutting devices, specifically to hand-held cutting devices, and more specifically, to hand-held cutting devices used for cutting explosive detonating cords.

2. Description of the Prior Art

Detonating cords that are used for setting off explosive charges are formed as lengths of packed explosive powder or crystals surrounded by a sheath or covering, such as nylon or rubber, that contains the explosive powder. The detonating cord may be supplied on a reel and cut to usable lengths. In utilizing the detonating cord, it is important that the ends of the cord are cleanly cut with the explosive core being level or flush with the surrounding sheath so that intimate contact can be made with explosive core of the detonating cord and the explosive being detonated.

Because of the characteristics of explosive detonating cord, conventional cutting devices used for cutting other materials cannot be used. Devices such as scissors or shears that apply a shearing and compressing action can damage the detonating cord, crushing and pinching the cord so that a clean cut is not achieved and creates a safety hazard to the operator.

One device that is often used for cutting detonating cord is a cap crimper. Although not intended to be used for such purposes, it is commonly used by those in the field who often find themselves without a sufficient tool for cutting the detonating cord. The cap crimper provides a less than adequate cutting device. The cap crimper is similar to a pliers. There is no sharp blade to provide a clean cut. The cap crimper tends to pinch the detonating cord, crushing the crystals forming the powdered explosive. This poses a safety hazard in itself. Further, this pinching action also tends to loosen the packed powdered explosive at the newly cut ends. This loose powder is usually lost so that the core explosive tends to be recessed from the end of the plastic or rubber sheath of the detonating cord. This creates an undesirable gap in the explosive of the detonating cord and the charge to be detonated.

An example of a prior art device that provides a fairly clean cut is shown in FIG. 1. The device 10 is formed from a solid piece of aluminum. A bore 12 is drilled through the length of the block and a transverse slot 14 intersecting the bore 12 is cut into the block. The detonating cord is then inserted through the bore 12. A razor blade (not shown) can then be inserted into the slot 14 and pressed downward so that the detonating cord is cut. This provides a fairly clean cut, but because the razor blades must be held in one's hands and because a fairly large force must be exerted on the blade in order to cut the detonating cord, there is a safety risk associated with this device. Further, the razor blades are routinely lost or misplaced.

What is therefore needed is a device for cutting detonating cords that provides a clean cut, without pinching or crushing of the explosive core, and that is safe and easy to use, and simple in design and construction.

SUMMARY OF THE INVENTION

A device for cutting a detonating cord having an explosive core is formed from a detonating cord holding member. The detonating cord holding member has a cord holding portion, such as an aperture or recess, configured to closely receive the detonating cord so that the detonating cord is held in place relative to the holding member. The cord holding member also has a side surface from which the detonating cord projects when the detonating cord is held in the cord holding portion prior to cutting.

A blade arm is pivotally mounted to the cord holding member. The blade arm carries a sharpened blade and is pivotal between an open and closed position. The blade passes over the cord holding portion in close proximity to the side surface so that the detonating cord is cut by the blade as the blade is passed over the cord holding portion. In this way a clean cut can be made to the detonating cord without pinching or crushing the core explosive.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

Figure 1:
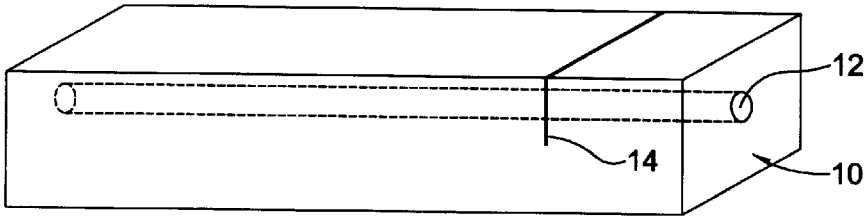
Fig. 1 (Prior Art)
FIG. 1 is a perspective view of a prior art cutting device for cutting explosive detonating cord.
Figure 2:
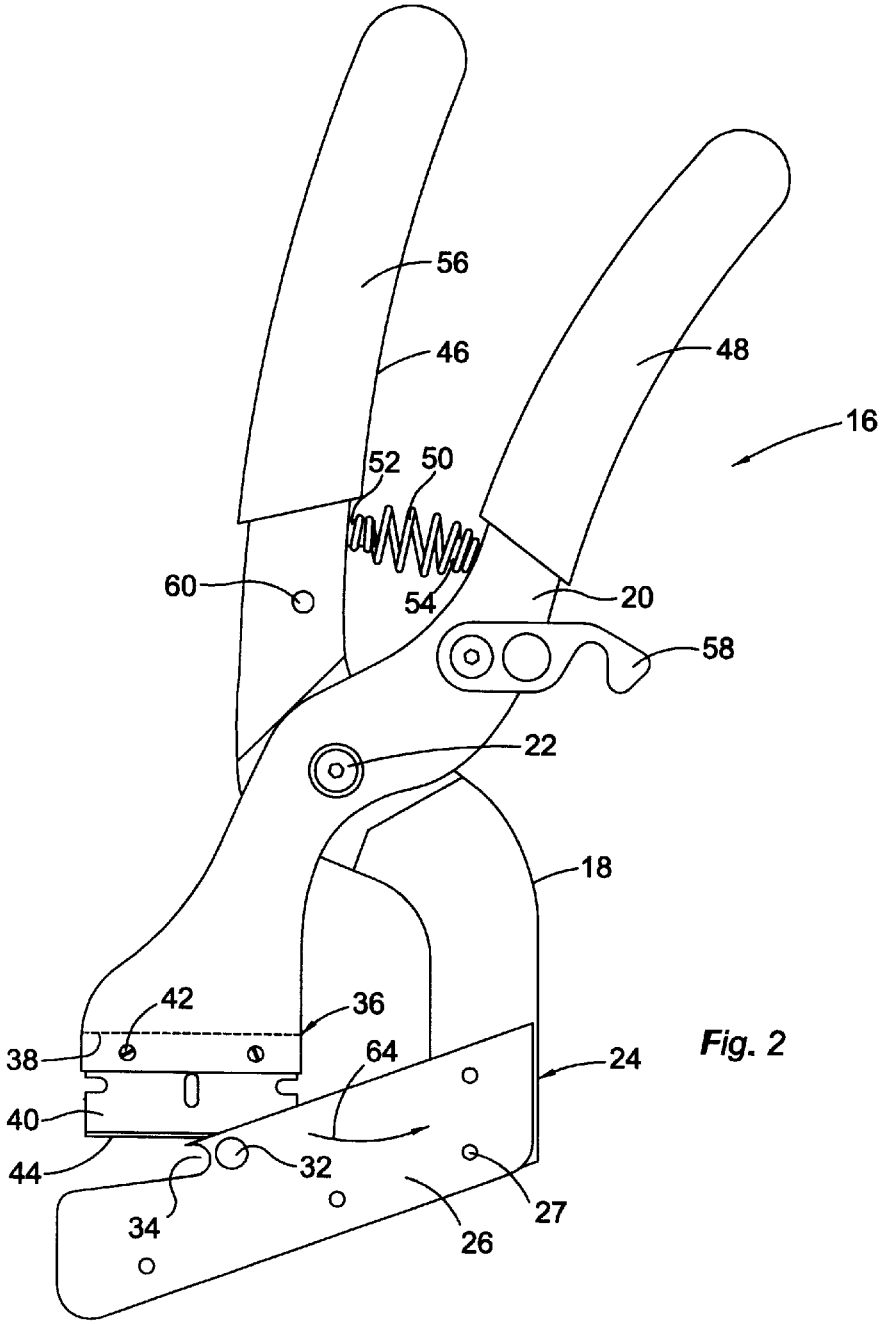
FIG. 2 is a side view of a device for cutting explosive detonating cord, shown with a blade arm of the device in an open position and constructed in accordance with the invention.

Referring to FIG. 2, a hand-held detonating cord cutter 16 is shown. The detonating cord cutter 16 is formed from two lever arms 18, 20 that are pivotally joined together generally at their midsections by means of a bolt 22. The lever arms 18, 20 are preferably formed from forged aluminum, or other non-sparking metal, such as brass. Joined to the forward end of the lever arm 18 is a detonating cord holding block 24. The holding block 24 is also formed from aluminum or other non-sparking metal.

Figure 3:
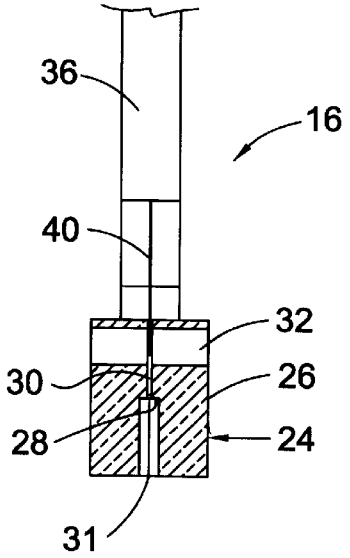
FIG. 3 is a partial front view of the device of FIG. 2, shown with a detonating cord holding member in cross section and constructed in accordance with the invention.
Figure 4:
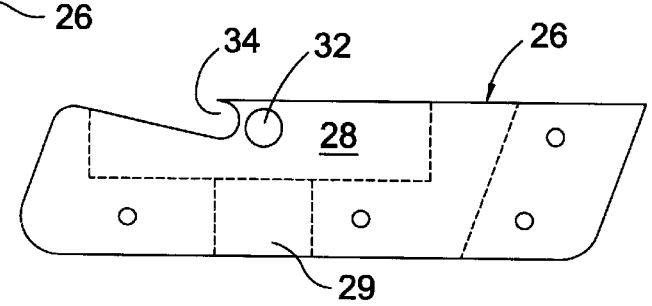
FIG. 4 is a side view of a plate of the detonating cord holding member constructed in accordance with the invention.

Referring to FIGS. 3 and 4, the holding block 24 is formed from a pair of plates 26 that are each constructed similarly, one being the mirror image of the other. The plates 26 abut one another and are joined together by fasteners 27 (FIG. 2). The fasteners 27 also join the block 24 to the lever arm 18.

A blade slot 30 is formed in the upper surface of the holding block, each plate 26 being provided with a flat, recessed area 28 on its inner surface that forms the blade slot 30 when the plates 26 are joined together, as shown in FIG. 3.

A recessed area 29 located below the recessed area 28 is formed on each plate 26. The recessed area 29 is deeper than the recessed area 28 and forms a slot 31 (FIG. 3) in the bottom of the holding block 24 when the plates 26 are joined together. The slot 31 is in communication with the slot 30 and allows the holding block 24 to be cleaned of any residue.

A circular detonating cord aperture 32 is formed in each plate, which extends transversely through the plate from the outer surface of each plate 26 to the recessed area 28 of the inner surface. The apertures 32 of each plate 26 are concentrically aligned and perpendicular to the blade slot 30, as shown in FIG. 3, when the plates 26 are joined together, to allow the detonating cord to be cut to be passed transversely through the thickness of the holding block 24 through the blade slot 30. The circular aperture 32 should be sized and configured to closely receive and circumferentially enclose a portion of the detonating cord's length immediately adjacent to where it is to be cut.

Formed in the holding block 24 adjacent to the aperture 32 is a transverse detonating cord slot or recess 34. The recess 34 is formed in the recessed area 28 of each plate 26 along the upper edge so that it extends across the blade slot 30 parallel to the aperture 32 when the plates are joined together. The recess 34 has a generally uniform cross section that is a concave curve having a single radius of curvature that is configured to closely receive the detonating cord to be cut. The recess 34 may have a radius of curvature equal to that of the circular aperture 32 or it may have a different radius of curvature so that it can be used for cutting a different size detonating cord. Both the aperture 32 and recess 34 are located directly above the slot 31.

The forward portion of the lever arm 20 terminates in a blade carrier 36 having a blade recess 38 (FIG. 2) for receiving the upper end of a generally flat razor blade 40. The razor blade 40 is retained in the recess 38 by means of steel set screws 42. The razor blade has a single sharpened edge 44 at the lower end. When the lever arms 18, 20 are joined together, the razor blade 40 will be longitudinally aligned with the blade slot 30 of the holding block 24.

The rearward ends 46, 48 of the lever arms 18, 20, opposite the holding block 24 and blade carrier 36, form handles of the device 16. An outwardly biased coiled spring 50 is positioned between the handles 46, 48 and is mounted at opposite ends on retaining posts 52, 54. The coiled spring 50 urges the lever arms 18, 20 to an open position, as will be more fully described herein. The rearward ends 46, 48 of the lever arms 18, 20 may be covered in plastic or rubber 56 to facilitate gripping.

A locking tab 58 is provided on the handle 48 of the lever arm 20. The locking tab 58 engages a post 60 formed on the handle 46 of lever arm 18. The locking tab 58 keeps the handles 46, 48 closed together when the device 16 is not in use.

Figure 5:
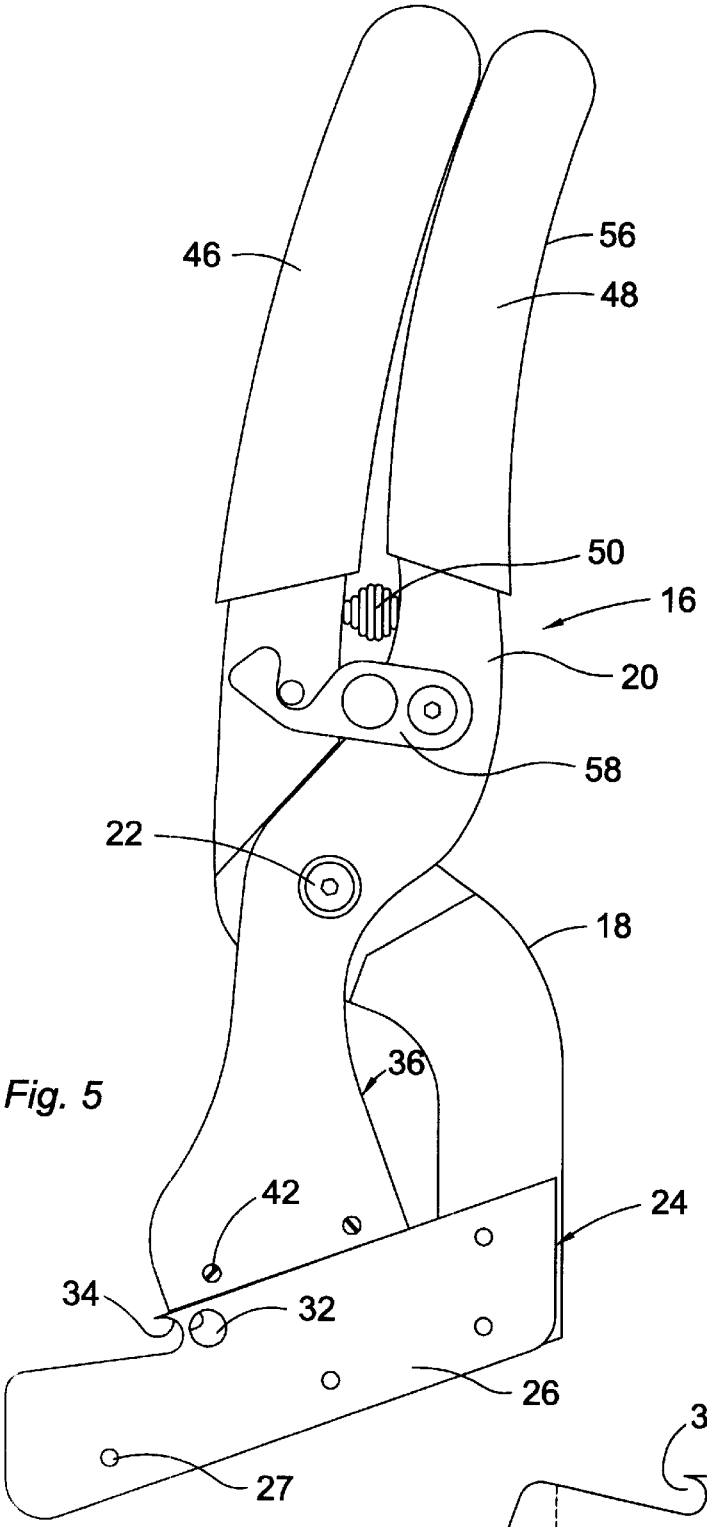
FIG. 5 is a side view of the cutting device of FIG. 2, shown with the blade arm in the closed position.

Referring to FIG. 5, when the handles 46, 48 are closed together, the razor blade 40 projects into the blade slot 30 and the lower edge of the blade carrier 36 will rest on the upper surface of the holding block 24 to prevent further closing of the handles 46, 48. The slot 30 is elongated and of sufficient depth to accommodate the blade 40 as it is moved between the open and closed position so that the sharpened edge 44 never contacts the bottom or edges of the slot 30. The blade slot 30 should closely receive the blade 40 so that only a slight clearance exists between the side edges of the slot 30 and the blade 40 to thus maintain the blade 40 in close proximity to the side edges 28.

Referring to FIGS. 2 and 3, when the handles 46, 48 are opened or spread apart, the blade carrier 36 is pivoted away from the holding block 24 so that the blade 40 is withdrawn from the slot 30, fully clearing the aperture 32 and recess 34.

The operation of the cutting device 16 is as follows. With the cutting device 16 closed, as shown in FIG. 5, the locking tab 58 is first removed from the post 60. The spring 50 causes the handles 46, 48 to open, as shown in FIG. 2, so that the blade carrier 36 is pivoted about pivot point 22 relative to the holding block 24 and the blade 40 is withdrawn from the blade slot 30. When fully opened, the blade 40 will fully clear the recess 34 and aperture 32 to allow insertion of the detonating cord.

Figure 6:
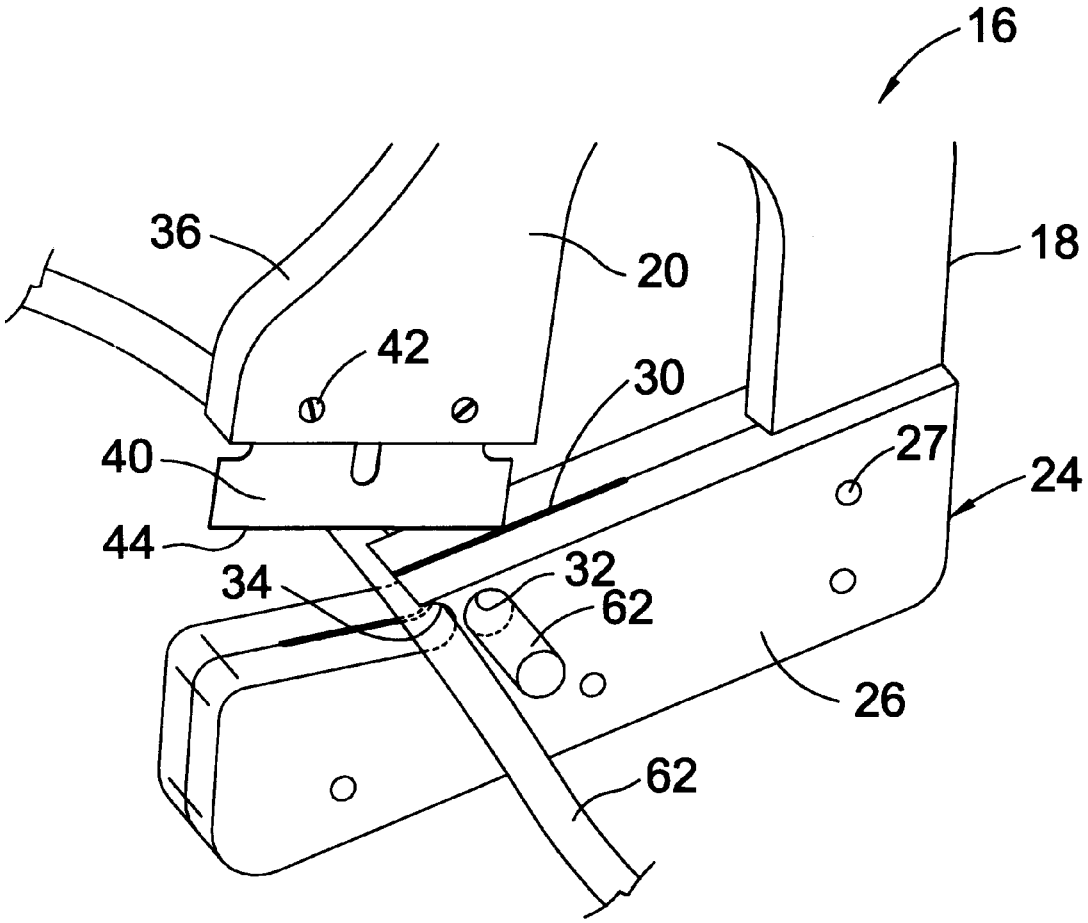
FIG. 6 is a perspective view of the cutting device of FIG. 2, shown with detonating cords held by the detonating cord holding member prior to cutting.

To make a clean cut at the end of the detonating cord, the end of the detonating cord 62 to be cut is first fully inserted longitudinally into the aperture 32 of the holding block 24, as shown in FIG. 6. When inserted into the aperture 32, a portion of the detonating cord 62 will project within the slot 30 from the side surfaces 28. With the detonating cord 62 positioned within the aperture 32, the handles 46, 48 are manually closed by the user so that the blade carrier 36 and blade 40 are pivoted to the closed position.

As the blade 40 is moved between the open and closed position, the blade 40 is swung in an arc, as indicated by the arrow 64 (FIG. 2). The cutting edge 44 of the blade 40 is oriented at an angle in relation to the lever arm 20 so that as the blade carrier 36 and blade 40 are moved between this opened and closed position, the length of the cutting edge 44 of the blade passes across the aperture 32 and through the entire thickness of the detonating cord 62. Thus, the blade 40 actually slices through the detonating cord 62 instead of making a downward chopping action.

As the detonating cord 62 is being cut, the interior surfaces of the aperture 32 serve as a bearing or supporting surface around the entire perimeter of the cord 62 to maintain the cord in position and to keep the cord from being deformed as it is being cut. The slicing action of the blade 40, as well as the close proximity of the blade to the side edges 28 of the slot 30 and the aperture 32, also prevent bending or deformation of the cord so that a clean, straight cut is made without any pinching of the cord or crushing of the powdered explosive.

Release of the handles 46, 48 after the detonating cord is cut results in the blade carrier 36 and blade 40 being urged to the open position so that the blade 40 is exposed. After use, the handles 46, 48 should be locked together by means of the locking tab 58 and post 60. This keeps the blade 40 housed within the holding block 24, protecting the blade and preventing accidental contact with the blade's razor edge.

As the razor blade 40 begins to dull, it may be necessary to replace the blade 40. This is accomplished by merely loosening the set screws 42, removing the used blade and inserting a new one. The set screws 42 are then retightened and the device is ready for use again.

When it is necessary to cut long lengths of detonating cord, it may be impractical to thread the length of detonating cord longitudinally through the aperture 32. In such cases, the detonating cord 62 may be inserted laterally into the recess 34, as shown in FIG. 6. The operation of the device 16 is generally the same as that described when using the aperture 32 except that the detonating cord 62 is now held within the slot 34. Because the detonating cord 62 is not supported on all sides, as it is within the aperture 32, the cut may not be as clean. If necessary, the newly cut end can then be inserted into the aperture 32 and cut again to provide a cleaner cut.

The cutting device of the invention has many advantages over the prior art. It is simple in design and easy to manufacture and operate. The device provides a safe, clean cut to the ends of the detonating cord without pinching or crushing. The arc or slicing motion of the blade makes a safer and cleaner cut than cutting devices that use a chopping action. The device can be used quickly for cutting both short and long lengths of detonating cord. The blade is safely stored with the device itself when not in use. There is no need to remove the blade to prevent accidental cutting or damage to the blade.

While the invention has been shown in only one of its forms, it should be apparent to those skilled in the art that it is not so limited but is susceptible to various changes without departing from the scope of the invention.

What is claimed is:

1. A method of cutting a detonating cord having an explosive core comprising:

providing a detonating cord holding member having a detonating cord holding portion configured to closely receive the detonating cord to be cut, the detonating cord holding member having a side surface;

pivotally mounting a blade arm to the detonating cord holding member, the blade arm carrying a sharpened blade, the blade arm being pivotal between an open and closed position;

inserting the detonating cord into the detonating cord holding portion so that the detonating cord is held in place relative to the detonating holding member and the detonating cord extends from the side surface;

pivoting the blade arm so that the blade passes over the cord holding portion in close proximity to the side surface so that the detonating cord is cut by the blade as the blade is passed over the detonating cord holding portion, the cut creating two cut portions of cord, two separate plates supporting each cut portion of, cord the two separate plates being coupled together to form the detonating cord holding member;

wherein the detonating cord holding portion has a first holding location which comprises an aperture through which the detonating cord is longitudinally inserted, thereby circumferentially enclosing at least a portion of the length of the detonating cord, the detonating cord holding portion also having a second holding location which comprises a recess in the cord holding member, the recess forming an exposed opening which allows a detonating cord to be inserted laterally into the recess; and wherein shorter lengths of detonating cord are longitudinally inserted into the aperture for cutting and relatively longer lengths of detonating cord are laterally inserted into the recess for cutting.

2. The method of claim 1, wherein:

the detonating cord holding member has a blade slot that receives the blade when the blade arm is moved to the closed position, at least one side of the blade slot forming the side surface.

3. The method of claim 1, wherein:

the blade arm and the detonating cord holding member each have a handle portion; and wherein the blade arm is pivoted by grasping and moving the handle portions so that the blade arm is pivoted between the open and closed positions.

4. The device of claim 1, further comprising:

providing biasing means coupled to the blade arm for biasing the blade arm towards the open position.

5. The device of claim 1, wherein:

pivoting the blade arm causes the blade to move in a slicing motion wherein the length of the blade passes across the cord as the cord is being cut.

6. A device for cutting a detonating cord having a length and having an explosive core, the device comprising:

two lever arms, one lever arm coupled to a detonating cord holding member and the other lever arm coupled to a blade arm, the two lever arms being pivotally joined at their midsection;

the detonating cord holding member having a detonating cord holding portion configured to closely receive the detonating cord so that at least a portion of the length of the detonating cord is held in place relative to the detonating cord holding member;

the blade arm carrying a sharpened blade, the blade arm being pivotal between an open and closed position relative to the detonating cord holding member, and wherein the blade passes over the detonating cord holding portion so that the detonating cord is cut by the blade as the blade is passed over the detonating cord holding portion, the cut creating two cut portions of cord;

wherein two separate plates support each cut portion of cord, the two plates being coupled together to form the detonating cord holding member;

wherein the detonating cord holding portion has a first holding location which comprises an aperture through which the detonating cord is longitudinally inserted, thereby circumferentially enclosing at least a portion of the length of the detonating cord, the detonating cord holding portion also having a second holding location which comprises a recess in the detonating cord holding member, the recess forming an exposed opening; and wherein the detonating cord holding member has a blade slot that receives the blade when the blade arm is moved to the closed position, the aperture in the detonating cord holding member being generally perpendicular to the blade slot.

7. The device of claim 1, wherein:

the blade arm and the detonating cord holding member each have a handle portion for manually pivoting the blade arm between the open and closed positions.

8. The device of claim 1, wherein:

at least one of the two separate plates that are coupled together to form the detonating cord holding member has a recessed area that forms the blade slot when the plates are coupled together.

9. The device of claim 1, further comprising:

biasing means coupled to the blade arm for biasing the blade arm towards the open position.

10. The device of claim 1, wherein:

the blade is oriented in relation to the blade arm so that the blade moves in a slicing motion wherein the length of the blade passes across the detonating cord holding portion when the blade arm is pivoted between the open and closed positions.

11. A hand-held device for cutting a detonating cord having a length and having an explosive core, the device comprising:

two lever arms, one lever arm coupled to a detonating cord holding member and the other lever arm coupled to a blade arm, the two lever arms being pivotally joined at their midsection;

the detonating cord holding member having a blade slot and having a detonating cord holding portion comprising an aperture that extends across the blade slot and is sized to closely receive the detonating cord to be cut so that the detonating cord extends through the aperture and across the blade slot of the detonating cord holding member;

the blade arm carrying a sharpened blade, the blade arm being pivotal between an open and closed position relative to the detonating cord holding member, and wherein the blade projects into and is closely received by the blade slot so that the detonating cord is cut by the blade when the detonating cord is held therein, the cut creating two cut portions of cord;

wherein two separate plates support each cut portion of cord, the two plates being coupled together to form the detonating cord holding member;

wherein each of the detonating cord holding member and the blade arm have a handle portion for manually pivoting the blade arm between the open and closed positions;

wherein the aperture in the detonating cord holding portion comprises a first holding location for a detonating cord to be cut which is longitudinally inserted within the aperture and wherein the detonating cord holding portion also has a second holding location which comprises a recess in the detonating cord holding member, the recess forming an exposed opening which allows a detonating cord to be inserted laterally into the recess.

12. The device of claim 11, wherein:

at least one of the two separate plates that are coupled together to form the detonating cord holding member has a recessed area that forms the blade slot when the plates are coupled together.

13. The device of claim 11, further comprising:

biasing means coupled to the blade arm for biasing the blade arm towards the open position.

14. The device of claim 11, wherein:

the blade is oriented in relation to the blade arm so that the blade moves in a slicing motion wherein the length of the blade passes across the aperture when the blade arm is pivoted between the open and closed positions.

* * * * *